US005476408A

United States Patent [19]

Hoeting et al.

[11] Patent Number: 5,476,408

[45] Date of Patent: Dec. 19, 1995

[54] SOUND PRODUCING BALL

[76] Inventors: Michael G. Hoeting, 783 Delta Ave., Cincinnati, Ohio 45226; Sean Mullaney, 4328 Hays Ave., Cincinnati, Ohio 45223

[21] Appl. No.: 276,367

[22] Filed: Jul. 18, 1994

[51] Int. Cl.[6] ..... A63H 5/00

[52] U.S. Cl. ..... 446/419; 446/409; 273/58 E; 273/58 F

[58] Field of Search ..... 84/402; 446/397, 446/409, 418, 419, 437, 69, 227, 236, 265; D21/65; 273/58 F, 58 BA, DIG. 20, 109, 113–115, 58 R, 58 E; 119/702, 707; D30/160

[56] References Cited

U.S. PATENT DOCUMENTS

| | | | |
|---|---|---|---|
| 1,259,889 | 3/1918 | MacDonald | 446/409 |
| 1,368,386 | 2/1921 | Blake | 446/265 |
| 2,096,121 | 10/1937 | Manelia . | |
| 2,473,574 | 6/1949 | Davis . | |
| 2,784,526 | 3/1957 | Bounadere . | |
| 3,058,261 | 10/1962 | Lakin . | |
| 3,493,228 | 2/1970 | Hicks | 446/419 |
| 3,655,197 | 4/1972 | Milbaum | 273/58 F |
| 4,451,038 | 5/1984 | Nagy | 273/113 |
| 4,645,471 | 2/1987 | Herring et al. | 446/409 |
| 4,822,044 | 4/1989 | Perkitny | 273/58 F |
| 4,897,069 | 1/1990 | Overturf | 446/219 |
| 5,237,903 | 8/1993 | Bein et al. | 446/419 |
| 5,351,650 | 10/1994 | Graves | 119/707 |

FOREIGN PATENT DOCUMENTS

| | | | |
|---|---|---|---|
| 2111839 | 7/1983 | United Kingdom | 273/58 F |

*Primary Examiner*—Robert A. Hafer
*Assistant Examiner*—Jeffrey D. Carlson
*Attorney, Agent, or Firm*—Kurt R. Benson

[57] ABSTRACT

A sound producing ball includes concentric inner and outer ball elements and a plurality of sound producing particles in an open area therebetween. The sound producing particles are dimensioned to travel in the open area when the ball is rotated, and the inner ball element has a plurality of projections thereon for redirecting the sound producing particles as they travel in the open area. The sounds produced by the sound particles as they strike the inner and outer ball elements are generally similar to the sound of rain striking a building roof.

7 Claims, 3 Drawing Sheets

SOUND PRODUCING BALL

BACKGROUND AND SUMMARY OF THE INVENTION

The instant invention relates to toys, and more particularly to a ball which is adapted to produce sounds which are generally similar to those produced by rain striking a building surface.

It has generally been found that devices which are capable of producing certain familiar sounds, such as sounds which simulate the sound of rain striking a building roof, have significant levels of appeal. This is partially because of the generally soothing affects of sounds of this type, and partially because of the general play value of sound-producing devices, particularly those which are adapted for use by young children. In this regard, a number of sound-producing devices have been heretofore available, including those disclosed in the U.S. Pat. Nos. to Manelia, 2,096,121; Davis, 2,473,574; Bounadere, 2,784,526; Lakin, 3,058,261; Herring et al., 4,645,471; and Bein et al., 5,237,903. In general, these devices have been found to have appeal among persons of various age groups, but particularly among young children.

The instant invention provides a novel sound-producing ball which has been found to have an increased level of appeal among young children. More specifically, the ball of the instant invention has been found to be capable of providing significant levels of amusement for young children by enabling them to produce sounds which realistically simulate the sounds produced by rain.

Still more specifically, the ball of the instant invention comprises concentric inner and outer ball elements which are dimensioned so that they cooperate to define an open area therebetween and a plurality of sound particles in the open area which are dimensioned to loosely travel therein as the ball is rotated. The inner and outer ball elements are preferably of substantially spherical configuration and preferably at least one of the inner and outer ball elements is made of a relatively hard plastic material. The sound particles are preferably also made from a relatively hard plastic material, and the ball preferably further includes a plurality of projections on at least one of the inner and outer ball elements which extend into the open area for redirecting the sound particles as they travel therein. The projections are preferably formed on the inner bail element, and they preferably extend outwardly into the open area terminating in spaced relation to the outer ball element. Further, the projections are preferably of generally triangular configuration, and they preferably taper in their outward extents toward the outer ball element. Even still further, the outer ball element is preferably made from a transparent plastic material, the inner ball element is preferably made from an opaque plastic material, and the sound elements are preferably formed in a variety of different attractive colors to provide a unique visual affect when the sound elements travel in the open area between the inner and outer ball elements as the ball is rotated.

It has been found that the overall construction of the ball of the instant invention makes it highly appealing to young children. Specifically, it has been found that the overall construction, which includes concentric inner and outer ball elements, a plurality of projections on the inner ball element, and a plurality of sound particles in the open area between the inner and outer ball elements provides a highly effective mechanism for producing soothing sounds which generally resemble the sounds produced by rain striking a building surface, such as a roof. It has been further found that the unique visual affects achieved by constructing the outer ball element from a transparent plastic material, the inner ball element from an opaque plastic material, and the game elements from a plastic material in various colors significantly increases the overall amusement value of the bail of the instant invention for young children.

Accordingly, it is a primary object of the instant invention to provide an effective ball which is capable of producing sounds which simulate the sounds of rain striking a building surface.

Another object of the instant invention is to provide a ball which is capable of producing sounds which are both soothing and amusing for young children.

Another object of the instant invention is to provide a ball comprising spaced concentric inner and outer ball elements, a plurality of outwardly extending projections on the inner ball element, and a plurality of sound elements in the open area between the inner and outer ball elements.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
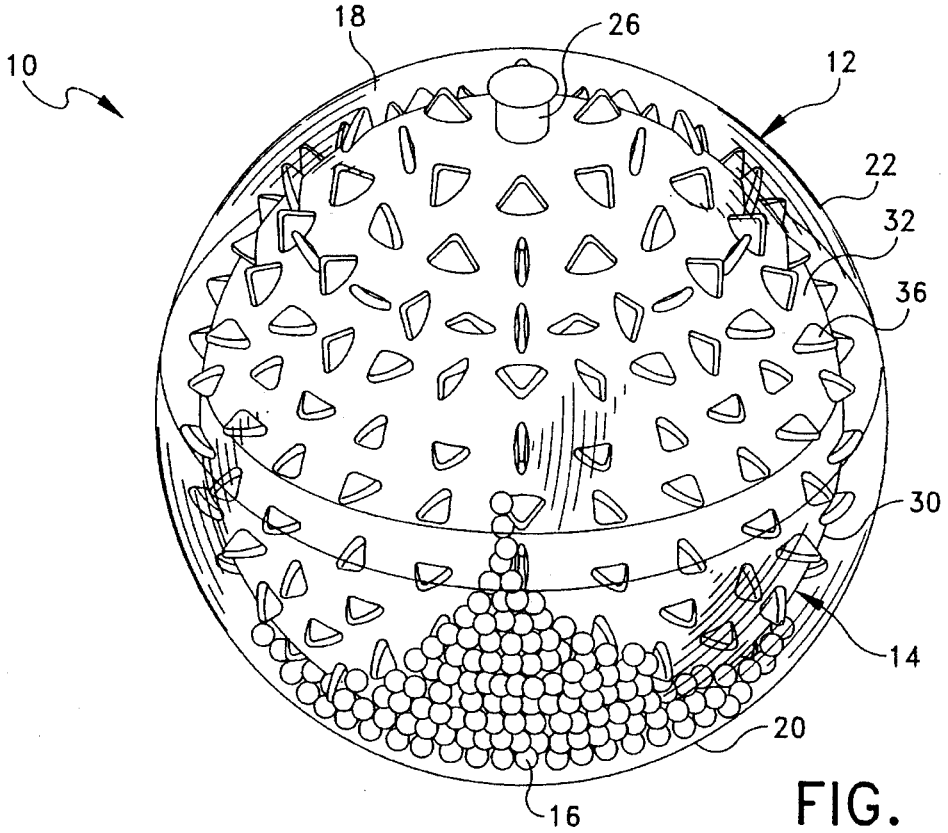
FIG. 1 is a perspective view of the ball of the instant invention.

Referring now to the drawings, the sound producing ball of the instant invention is illustrated and generally indicated at 10 in FIGS. 1 through 4. The ball 10 comprises an outer ball element generally indicated at 12, an inner ball element generally indicated at 14, and a plurality of sound producing particles 16, which are contained in an opening 18 between the inner ball element 14 and the outer ball element 12. The sound producing particles 16 are adapted and dimensioned so that they can freely travel in a space or open area 18 between the outer ball element 12 and the inner ball element 14, and accordingly, they are operative for producing sounds as they strike the outer and inner ball elements 12 and 14, respectively, when the ball 10 is rotated.

Figure 2:
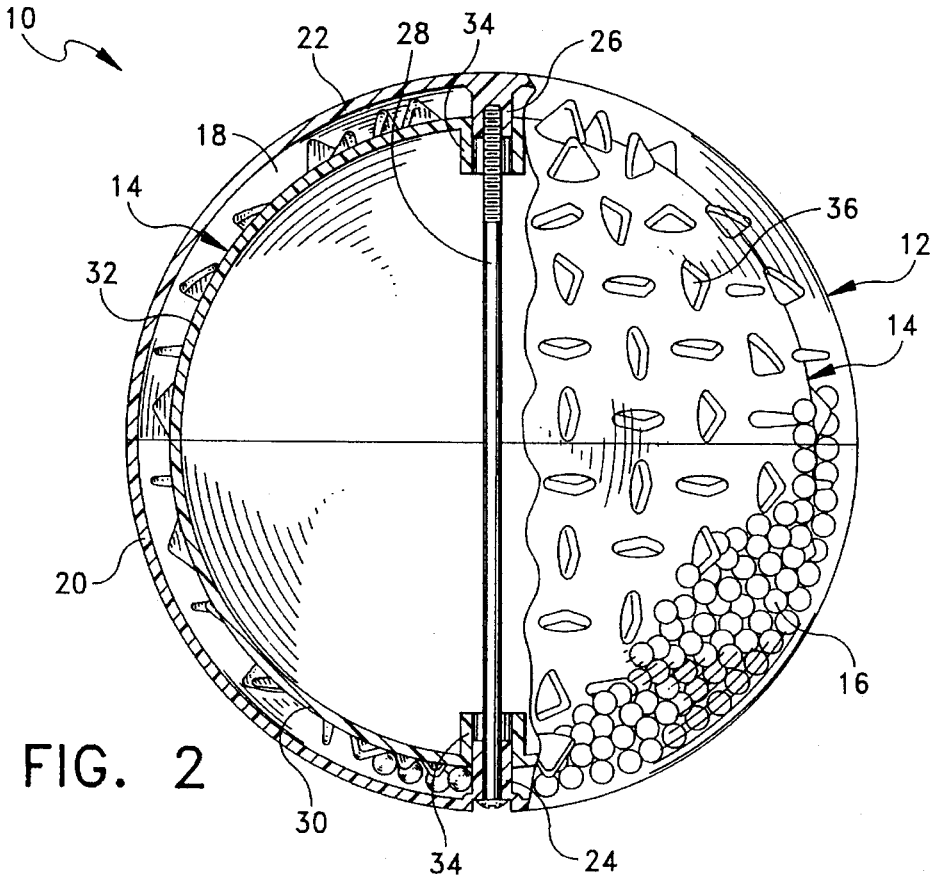
FIG. 2 is an elevational view thereof shown in partial section.
Figure 3:
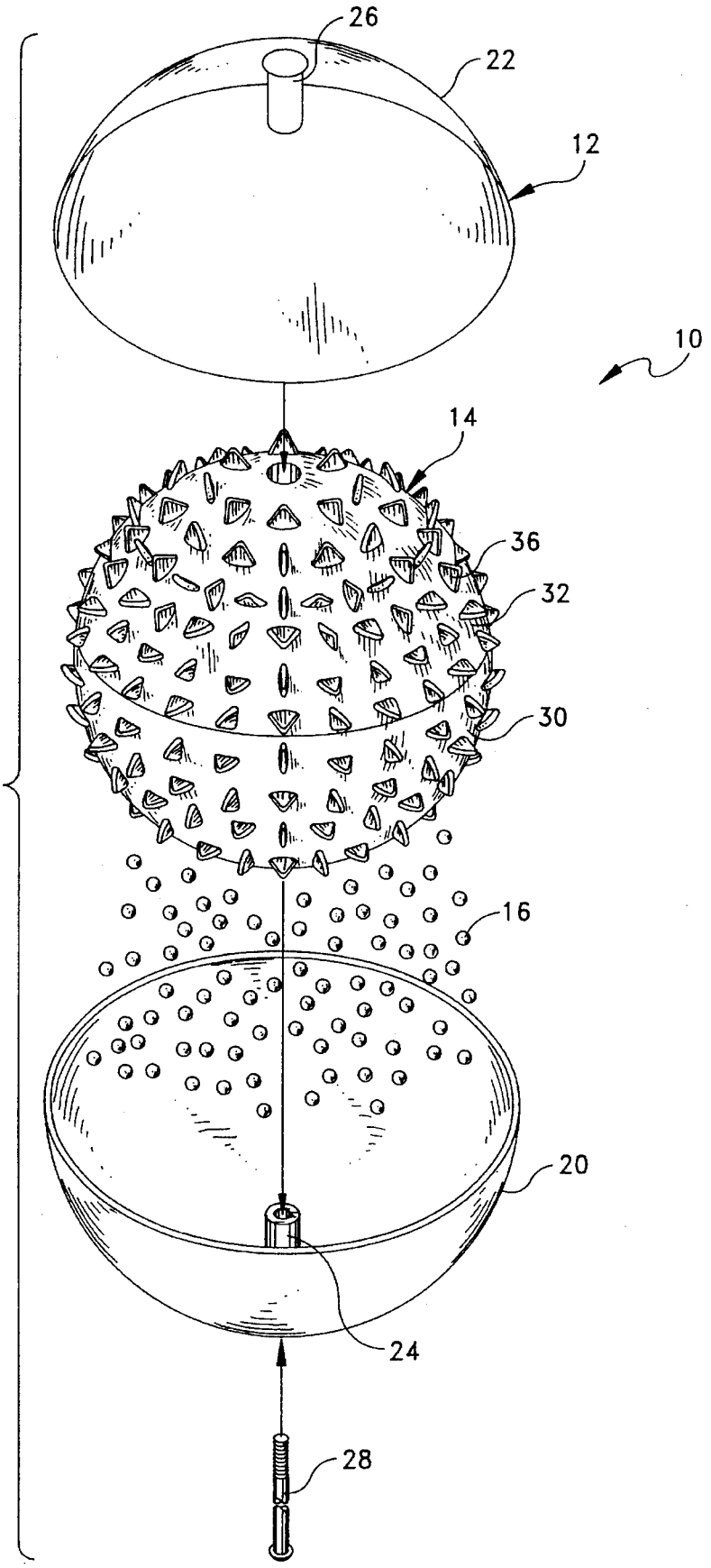
FIG. 3 is an exploded perspective view thereof.
Figure 4:
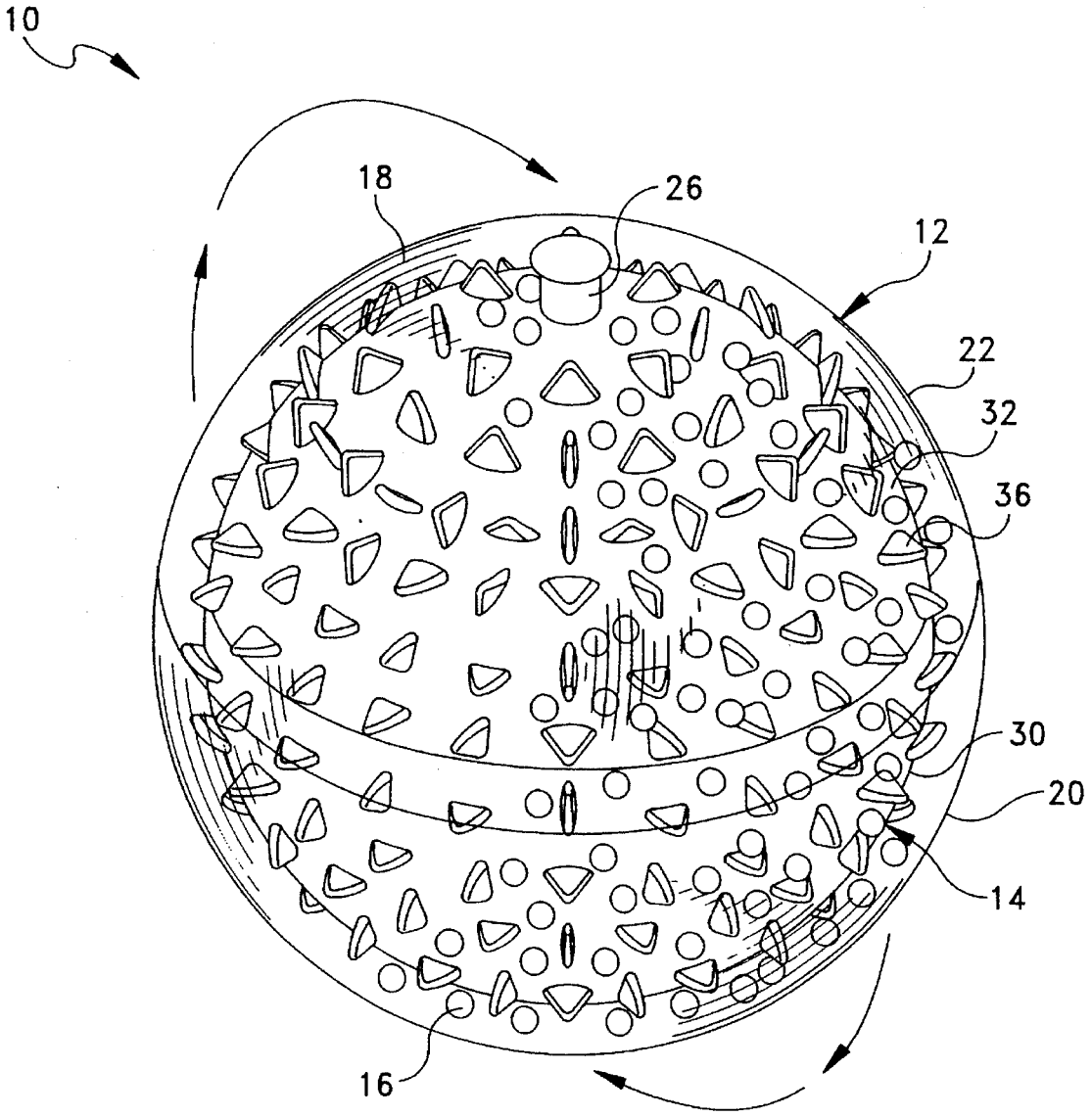
FIG. 4 is a perspective view of the ball of the instant invention during rotation thereof.

The outer ball element 12 is preferably made from a relatively hard rigid transparent plastic material in a generally spherical configuration, and it includes first and second hemispherical portions 20 and 22, respectively. The first hemispherical portion 20 has a first inwardly extending hub 24 formed therein, and the second hemispherical portion 22 has a second inwardly extending hub 26 formed therein. The hemispherical portions 20 and 22 are adapted to be assembled so that the hubs 24 and 26 are disposed in substantially aligned relation, and the outer ball element 12 further comprises an elongated threaded screw 28 which is received through the first hub 24 and received in threaded engagement in the second hub 26 as illustrated in FIG. 2. The threaded screw 28 is operative for maintaining the hemispherical portions 20 and 22 in assembled relation, and it is further operative for maintaining the second, or inner ball element 14 in substantially concentric spaced relation in the interior of the outer ball element 12 as illustrated.

The inner ball element 14 is preferably made from a relatively hard rigid opaque plastic material, and it comprises first and second hemispherical portions 30 and 32, respectively. The hemispherical portions 30 and 32 each include an elongated inwardly extending tubular hub 34, and each has a plurality of outwardly extending projections 36 formed thereon. As illustrated in FIG. 2, the tubular hubs 34 are adapted to receive the hubs 24 and 26 therein as illustrated. The first and second hemispherical portions 30 and 32 are preferably adhesively secured together, although they are also maintained in assembled relation in the manner illustrated in FIG. 2 by the screw 28. The projections 36 extend outwardly from the outer surface of the hemispherical portions 30 and 32, and they are formed in generally outwardly tapering triangular configuration. The projections 36 are positioned at various angles on the surface of the hemispherical portions 30 and 32, and they extend outwardly therefrom terminating in spaced relation to the inner surface of the outer ball element 12.

The sound particles 16 as herein embodied are formed as small spherical balls of a substantially uniform size, although it will be understood that sound particles of other configurations can also be utilized in the ball 10. The particles 16 are preferably formed from a relatively hard plastic material, and they are dimensioned so that they can travel freely in the open area 18 between the inner ball element 14 and the outer ball element 12. The ball 10 preferably comprises a relatively large number of the sound producing particles 16, and the particles 16 are preferably made in a variety of different colors to enhance the visual affect which is achieved as the particles 16 travel around the projections 36 in the open area 18.

As hereinabove noted, the outer ball element 12, the inner ball element 14, and the sound producing particles 16 are preferably all made from relatively hard plastic materials. In this regard, it will be understood that although "hard" is a relative term, as used herein, it is intended to mean a conventional substantially rigid plastic material having a relatively low level of resiliency, such as a plastic of a type commonly utilized for constructing rigid plastic toys and other products which are not intended to be deformable or flexible to any significant extent. It has been found that by constructing the ball elements 12 and 14 and the sound producing particles 16 from relatively hard rigid plastic materials, the sounds produced by rotating the ball 10 generally have increased audio characteristics, and they generally more closely simulate the sounds of raindrops striking a surface such as a roof of a building.

It is seen, therefore, that the instant invention provides an effective sound producing ball. The ball 10 is adapted so that the particles 16 can freely travel between the ball elements 12 and 14, and so that the particles are frequently redirected by the projections 36. It has been found that this has the effect of causing the particles 16 to frequently impact the surfaces of the ball elements 12 and 14 to produce sounds. Further, it has been found that because of the large quantity of particles 16 and the manner in which they are redirected so that they impact the ball elements 12 and 14, the ball 10 is capable of producing relatively soothing sounds which simulate the sound of rain striking a building surface. Hence, it is seen that the ball 10 represents a significant advancement in the toy art which has both a high level of appeal and substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sound producing ball comprising:

a hollow outer ball element comprising an outer shell having a continuous inner surface thereon;

an inner ball element comprising an outer shell having a continuous outer surface thereon secured in spaced substantially concentric relation in said outer ball element such that the outer surface of the inner ball element and the inner surface of the outer ball element are in substantially uniformly spaced relation and cooperate to define an open area therebetween;

a plurality of discreet relatively hard sound particles in said open area, said sound particles being dimensioned to loosely travel in said open area when said ball is rotated; and a plurality of projections on at least one of said inner and outer ball elements extending into said open area for redirecting said sound particles as they travel in said open area, said projections being closely spaced in an array extending around substantially the entire outer surface of said inner ball element.

2. In the sound producing ball of claim 1, said inner and outer ball elements being substantially spherical.

3. In the ball of claim 1, at least one of said inner and outer ball elements being made of a relatively hard plastic material, said sound particles also being made of a relatively hard plastic material, whereby said sound particles and said at least one ball element cooperate to produce sounds which resemble the sound of rain striking a building surface as said ball is rotated.

4. The ball of claim 1 wherein said plurality of projections are located on said inner ball element extending into said open area for redirecting said sound particles as they travel in said open area.

5. In the ball of claim 4, said projections terminating in spaced relation to said outer ball element.

6. In the ball of claim 4, said inner and outer ball elements, said projections and said sound elements all being made of a relatively hard plastic material to enhance the sounds produced when said ball is rotated.

7. In the ball of claim 1, said outer ball element being made of a transparent plastic material.

* * * * *